US005083321A

United States Patent [19]

Davidsson

[11] Patent Number: 5,083,321

[45] Date of Patent: Jan. 28, 1992

[54] HEADGEAR WITH SECURING STRUCTURE FOR SUPPORT STRAPS

[76] Inventor: Lennart Davidsson, Videgatan 11, S-334 00 Anderstorp, Sweden

[21] Appl. No.: 639,380

[22] Filed: Jan. 11, 1991

Related U.S. Application Data

[63] Continuation of Ser. No. 469,504, Apr. 30, 1990, abandoned.

[30] Foreign Application Priority Data

Aug. 28, 1987 [SE] Sweden ..... 8703340
Sep. 25, 1987 [SE] Sweden ..... 8703751

[51] Int. Cl.[5] ..... A42B 7/00
[52] U.S. Cl. ..... 2/421; 2/425
[58] Field of Search ..... 2/410, 411, 414, 421, 2/422, 425

[56] References Cited

U.S. PATENT DOCUMENTS

| | | | |
|---|---|---|---|
| 694,986 | 3/1902 | Pierce | 2/414 |
| 1,483,881 | 2/1924 | Hart | 2/412 |
| 2,629,095 | 2/1953 | Kleinman | 2/414 |
| 2,717,384 | 9/1955 | Frothingham | 2/414 |
| 3,239,842 | 3/1966 | Marchello | 2/422 |
| 3,480,966 | 12/1969 | Molitoris et al. | 2/421 |
| 3,783,450 | 1/1974 | O'Conner | 2/421 |
| 3,790,962 | 2/1974 | Plastino | 2/411 |
| 4,044,400 | 8/1977 | Lewkki et al. | 2/421 |
| 4,398,306 | 8/1983 | Gooding | 2/421 |
| 4,434,514 | 3/1984 | Sundaml et al. | 2/425 |
| 4,443,891 | 4/1984 | Blomgren et al. | 2/414 |
| 4,461,044 | 7/1984 | Reitermann et al. | 2/421 |
| 4,653,123 | 3/1987 | Broersma | 2/425 |

FOREIGN PATENT DOCUMENTS

| | | | |
|---|---|---|---|
| 291308 | 11/1988 | European Pat. Off. | 2/410 |
| 2075820 | 11/1981 | United Kingdom | 2/425 |

*Primary Examiner*—Werner H. Schroeder
*Assistant Examiner*—Michael A. Neas
*Attorney, Agent, or Firm*—Howson & Howson

[57] ABSTRACT

Headgear for bicycling and other activities comprises a hood comprising a porous, energy-absorbing molded plastics material with at least one strap for securing the hood to the head of a wearer, the strap being secured to a bow-shaped securing structure extending through an edge of the hood and partly embedded in material located between the inner and outer surfaces of the hood.

11 Claims, 5 Drawing Sheets

HEADGEAR WITH SECURING STRUCTURE FOR SUPPORT STRAPS

CROSS-REFERENCE TO RELATED APPLICATION

This application is a continuation of application Ser. No. 469,504, filed Apr. 30, 1990, and now abandoned.

TECHNICAL FIELD

The present invention relates to a headgear which is primarily intended for sports and recreation activities and which is designed to form or be able to form a safety helmet or the like. The headgear comprises a hood or similar which at least shows a frame and one or more support bands meant for support straps or similar which are intended to secure the headgear, hood or frame in a required position on a head of a person. It should perhaps be declared even at this beginning of the description of the invention that the frame referred to forms, or can form, the said hood, and provided with the support straps referred to forms, or can form, the said headgear.

BACKGROUND

The need exits for a new headgear which is able to form a safety helmet, be of low weight, and which is comfortable to wear, not least for children. An indispensable requirement in this respect is that a headgear of the type in question should remain in position on the head of the wearer in the event of an accident, blow, bump or the like, whereby it is of importance that the headgear can be adjusted to fit different personal sizes and shapes of head. Moreover, it is appreciated that the headgear is easy to put on and take off. Further, it is worth emphasizing that the headgear is really effective when used. A headgear of the type in question should be able to be produced at low cost so that it will be available for one and all.

TECHNICAL PROBLEMS

A known helmet or bicycle helmet primarily designed for children does not have inter alia attachment devices for support straps or the like. The support straps are thus arranged for the helmet by being threaded through ventilation openings arranged in the helmet or its hood. These ventilation openings are in the first place positioned in such a manner on the helmet or hood as to provide good ventilation, for which reason the positioning of the ventilation openings is not optimally adjusted for the attachment of the support straps and their running in the helmet, and at the same time the ventilation openings are not always positioned for effective ventilation. Besides, ventilation is obstructed by the support straps drawn through the ventilation openings. The running of the support straps is in this respect not of the best kind for the helmet to be maintained in an intended position in a reasonably manner, particularly not in the case of an accident and the like, where it is of critical importance that the helmet maintains its intended position on the head of the wearer. It is therefore easy for the helmet to be displaced from its intended position when for example bumps, sudden movements occurs, or when children are playing. It has proved to be the case that only a slight influence, such as a light bump or blow to or with the helmet, causes it to slip on the head out of position, which apart from missing the safety notwithstanding the use of a safety helmet implies the risk of a loss of vision if the helmet slips forwards and down over the face; the result of which can be disastrous for example in traffic, or for avoidance an accident or to mitigate the effects of an accident. The known helmet is therefore not effective when used and does not offer real protection. It is also the case that the helmet is made from a porous material, and one which is sensitive to abrasion, and therefore it is inappropriate to permit the support straps to run through the ventilation openings since these wear the material in the helmet or its hood and can damage the helmet, or at least undermine its strength. In addition, the ventilation openings are made after the helmet or hood has been manufactured, whereby the cut edges are especially porous.

The basis for the above mentioned problems is constituted by inter alia the fact that the helmet or hood is made from expanded plastic material which results in a porous product. It would thus be an improvement for a frame, hood or helmet to be manufactured in a simple and rapid manner and at a low cost, and also be of low weight simultaneously that the material has a high energy absorbing capacity. The material in the helmet or hood, however, has far too inferior strength and is too porous to enable the arrangement of support straps and the like to the helmet or hood in the normal way, for example by riveting. Openings have therefore been made through the helmet or hood, or the ventilation openings have been utilized, for support devices.

THE SOLUTION

In the case of a headgear or safety helmet according to the present invention, however, the set requirements are met and the disadvantages of known helmets are eliminated. During development of the helmet a method has thus been created of arranging attachment points on the helmet, hood or frame for example support straps, chin bands and the like, and also for other devices. The attachment points can also be arranged at places where the attachment of for example support straps and the like is the best so that, according to the example, the headgear or the like will sit and remain in place on the head of the wearer in the required manner, and also with optimum safety, but also so that it will sit comfortably on the head. It is thus possible to achieve an appropriate running of the support straps and similar from and to the helmet and in contact with the wearer to ensure a comfortable and safe use of the headgear. In addition, the attachment points by virtue of worked out holders have strength and cannot come loose, be damaged or otherwise impaired, or impair the quality of the headgear, the hood or the frame, thus reducing the safety factor and reliability, without the headgear, hood or frame being totally destroyed. The support straps, chin bands and similar can be amply adjusted so that the intended position and comfort can be achieved and maintained during the use of the headgear, hood or frame which also has ample adjustment potential in order that it can be adjusted to and fit different sizes and head shapes. The ventilation openings in the headgear, hood or frame can be arranged at the most appropriate places for the ventilation and be shaped simultaneously and in the same manufacturing process as the hood or frame. Then there is the high density in the material which prevents that the sections limiting the ventilation openings ensures the strength. The headgear, hood or frame can also be manufactured in a simple and rapid manner and at a low cost, and from the favorable material which lend the headgear, hood and frame an extremely low weight and an almost negligible load on the person wearing the headgear. These conditions, together with the fact that the headgear is easy to wear, to put on and take off, and adjust, have the result that the headgear can be used by one and all as it is also well suited for children. There is therefore nothing to prevent all the members of a family, for example, from having their own helmet. The side surfaces of the headgear, hood or frame can be given a high density which ensures greater resistance to blow and abrasion, etc., and also an aesthetically attractive design. An aesthetically attractive design will contribute to that the helmet which by its very nature is a necessary precaution actually gets used. The headgear in accordance with the invention is thus characterized in that the frame is made of porous, energy absorbing and shape permanence material, and that the holders for support straps and similar are arranged in the frame and with a part of parts protruding from the frame, and that said support straps or similar are combined with the frame by attachment in said protruding parts of said holders.

The invention also relates to a method to produce a headgear in accordance with the invention, whereby the headgear comprises a hood or similar and to the hood arranged or arrangeable support straps or similar, whereby the hood or a frame to the headgear or the hood is shaped by molding in a molding tool showing at least two mold halves. The method is characterized in that anchoring openings for holders or holders for connection of the support straps or similar to the headgear, the hood or the frame are arranged in the hood or the frame in connection with the molding of the hood or the frame in the molding tool, whereby in applicable cases said holders are placed in the molding tool before the molding of the hood or the frame and are molded into the hood or the frame and also brought with a part or parts to protrude from the hood or the frame.

BRIEF DESCRIPTION OF THE DRAWINGS

Further characteristics of and advantages with the headgear and the method to produce the headgear will in the following description of the invention become apparent in embodiments, whereby a simultaneous reference will be made to the accompanying schematic drawings, of which.

BEST MODE FOR CARRYING OUT THE INVENTION

Figure 1:
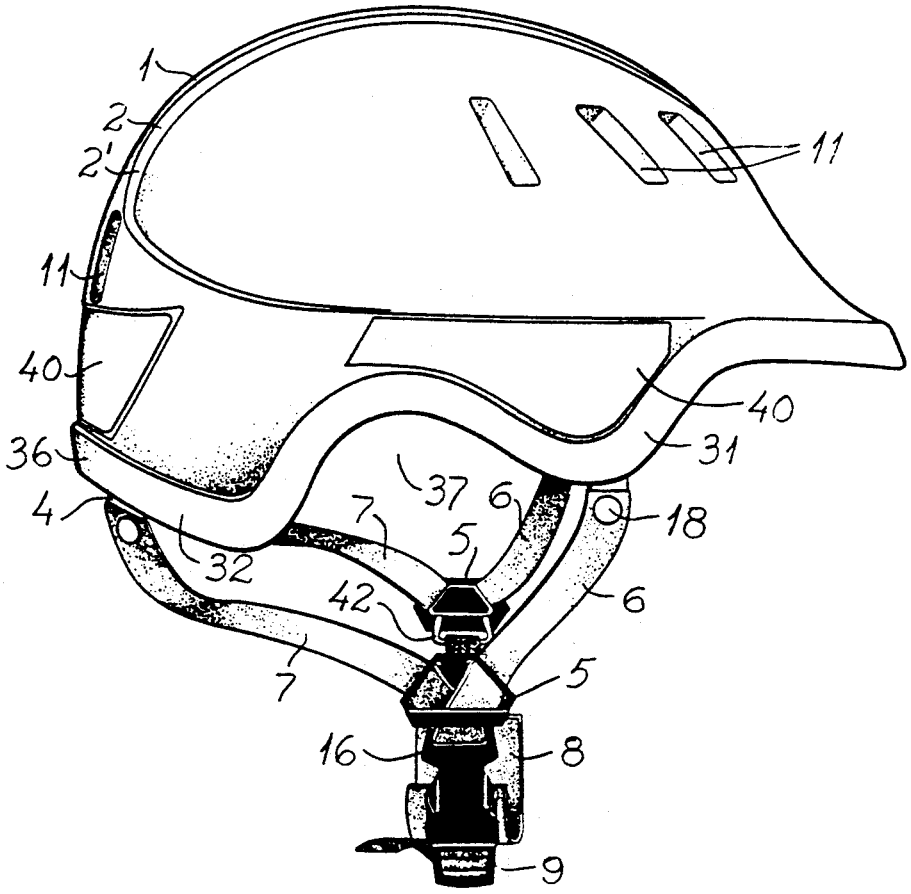
FIG. 1 shows a side view of a headgear according to one embodiment.

The reference designations 1, 2 and 2' in FIGS. 1–4 and 13 show a headgear, hood or a frame or a headgear, hood and a frame respectively. The frame 2' is molded from expanded plastic material, such as expanded polystyrene, in a molding tool showing at least two mold halves. The frame actually constitutes the hood 2 to the headgear 1 or the actual headgear 1. According to one embodiment the holder 3 or the like is arranged in the frame 2' and in connection with the molding and manufacturing of the frame, the hood or the headgear, whereby the frame 2' with the arranged holders 3 can be said to form a part of the headgear 1 or a hood 2. When the frame 2' or the hood 2 is provided with support straps 6, 7, chin band 8 or the like, the product constituted in this manner will form a headgear 1 or a safety helmet. For the sake of simplicity the headgear 1 or the like will in the following description of the invention be designated as safety helmet or helmet.

By molding the helmet from expanded plastic material a helmet is achieved with high energy absorbing and shock absorbing properties. When manufacturing in the manufacturing process one enables high density, thus ensuring compact material and above all a compact surface layer or compact surface layers for the helmet, the surface layer or layers of which are so compact that a subsequent machining or after-treatment to attain for example finish or the like is not necessary. Furthermore, helmets can be molded with varying decorations, patterns and the like, and also in different colors. The helmet can also be provided with decorations in the shape of decals 40 or the like.

Figure 5:
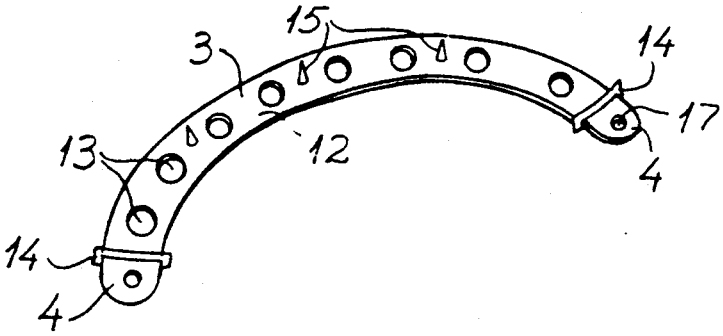
FIG. 5 shows in a perspective view one embodiment of a holder.

The holders 3 according to the embodiments are shaped as separate elements and made from plastic material which is relatively rigid and sufficiently rigid that an end section or end sections which will form protrusions 4, become rigid or stiff. At the same time, however, the holders 3 according to the embodiments shown in FIGS. 5–7 should be sufficiently flexible that they can be brought to an intended tensioning into the frame 2' during the manufacturing of the helmet. The holders 3 should also be made of a material with high strength.

The holders 3 show a number of recesses or openings 13 which save material and weight but promote the attachment of the holders in the helmet, since the material can penetrate in and through the openings and anchor the holders. Furthermore, there are end trusses, flanges 14 or the like which divide the holder 3 in an attachment part 12 and the protruding part 4 or parts. The flange 14 or flanges are located in the helmet's lower peripheral edge 38 and limit the molding chamber in the molding tool, since they are located in the peripheral edge of the molding chamber. Engagement devices 17 are arranged in the parts 4, for example in the shape of holes for connection of the support straps 6, 7 or the like.

Figure 6:
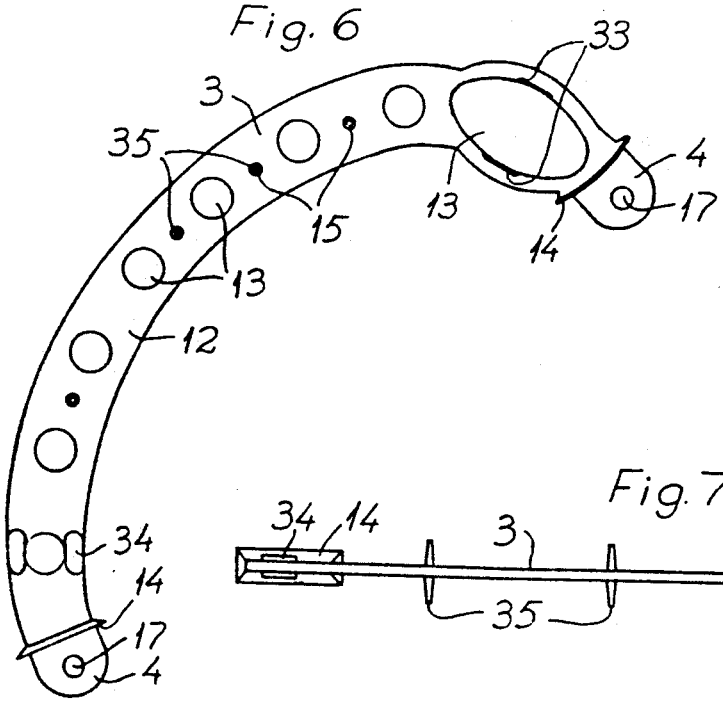
FIG. 6 shows from one side a second embodiment of a holder.
Figure 7:
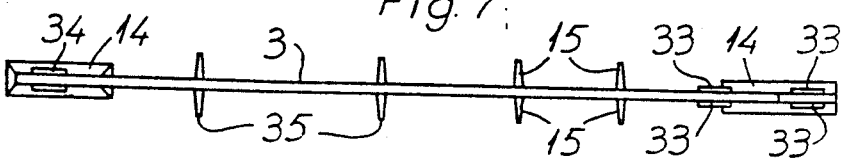
FIG. 7 shows from another side the holder in FIG. 6.
Figure 3:
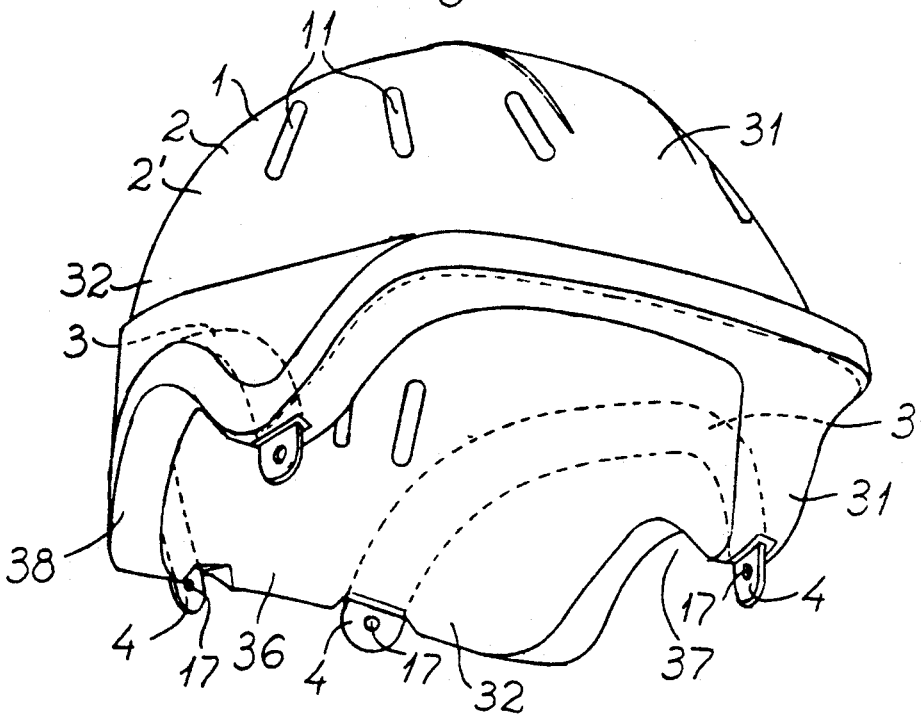
FIG. 3 and 4 show in a perspective view and from below a headgear without support support straps or the like or a hood or a frame with arranged holders.
Figure 4:
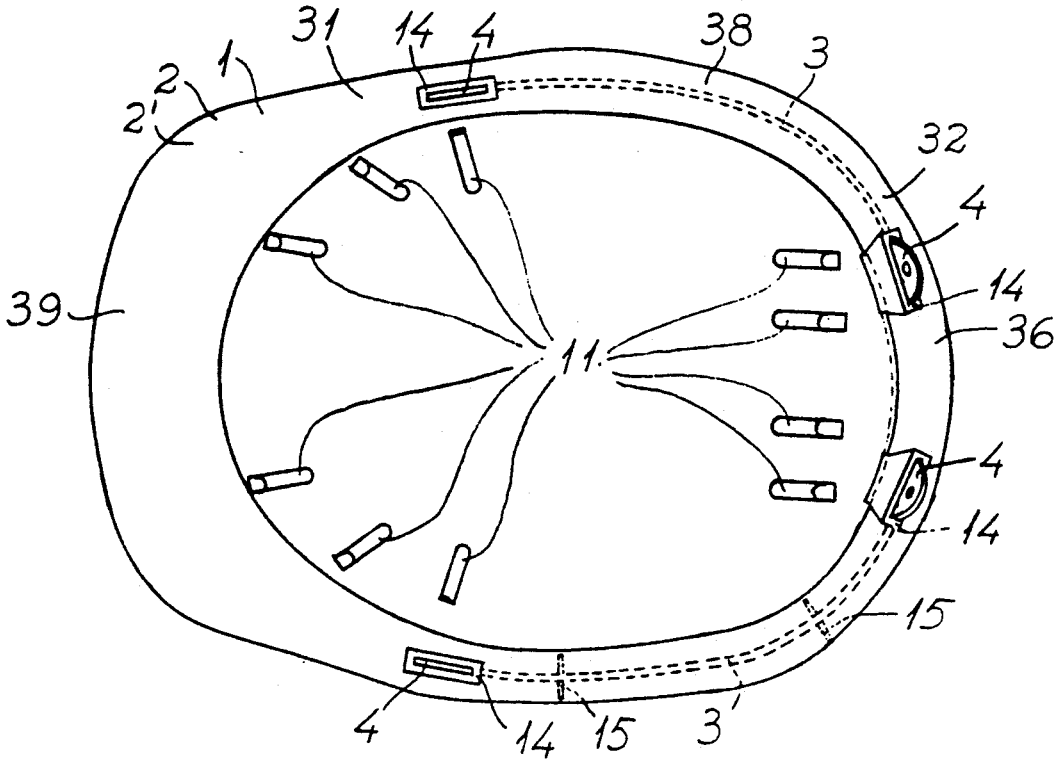

According to one embodiment and when the helmet 1, the hood or the frame 2' will be manufactured one or more, for example two bow shaped holders 3 each with two protruding parts 4 are arranged in the open molding tool, after which the molding tool is closed with at least two mold halves which guide or form the holders 3 to the correct cross sectional position in the mold chamber so that the holders will be molded in the middle of or between the surfaces of the helmet's or the like wall. This is done by the fact that the two mold halves touching position devices 15 shown by the holders 3 or touching contact surfaces 35 shown by the position devices. Position devices and contact surfaces are arranged and directed in opposite directions on the holders. This thus ensures that the holders 3 becomes located in the middle of the material, see FIG. 3 and 4. The frame 2' manufactured in this way with holders 3 forms in this case a hood 2 or a frame 2'. In order to further reinforce the attachment of the holders 3 and particularly in connection with the protruding part 4, which should be located in the front section 31 of the helmet, it is possible, as shown in FIG. 6 and 7, for an additional opening 13 to be shaped in the holder 3, plus arrangement of enlarged engagement surfaces 33 which are directed or substantially turned towards the direction in which the largest tensile stresses occur. In the holder's other end portion and in the vicinity of the protruding part 4, it is possible to arrange reinforcement portions 34 which reinforce the holder's end portion.

Figure 8:
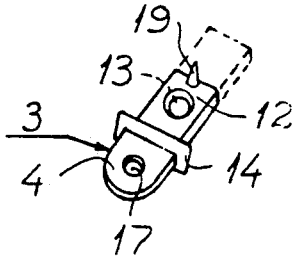
FIG. 8 shows in a perspective view a third embodiment of a holder.

In connection with the manufacturing of the helmet 1, the hood 2 or the frame 2', anchoring openings can be arranged for holders 3 which are arranged after the frame 2' or the hood has been manufactured and removed from the molding tool. In this case holders 3 are shaped as, for example, a peg or stud shaped devices, see FIG. 8, with an attachment part 12 which can be entered, pushed or pressed or the like into the frame 2' or the hood 2 and its material or into said and possibly arranged anchoring openings, after which the holders 3 are anchored with the aid of a medium, such as glue, by means of ultra-sound, whereby the holders are welded secure in the helmet, or by some other appropriate method. The holders 3 can also show a position device 19 or a fastening device 19 in the shape of a barb or the like. The attachment part 12 is shaped sufficiently long to ensure the securing of the holder which could also be fixed in the frame 2' in the molding tool in connection with the molding of the frame. The position devices 15 or 19 also promotes a reliable anchoring of the holders in the helmet 1, the hood 2 or the frame 2'.

Ventilation openings 11 in or through the helmet can be arranged at the same time and in the same manufacturing process as the manufacturing of the helmet 1, the hood 2 or the frame 2'. According to the invention the mold halves are each provided with pins which with a closed molding tool together form a bridge through the mold chamber. As per a second method, cores or the like are entered into the molding chamber of the molding tool which cores are drawn out from the chamber before the separation of the tool. Irrespective of which method is used, the limiting surfaces in the ventilation openings thus achieved are ensured a high density so that the surfaces will be closed and tight.

In order that the helmet 1 will provide the required protection it must sit on the head of the wearer in an intended way and in an assured position. For this reason, the hood 2 or the frame 2' is provided with or the helmet show support straps 6, 7 chin bands 8 plus a locking device 9 and further provided with adjusting devices 5 in the shape of a band distributor plus adjustment facilities in the chin band. It is important that the support straps and also the chin band have an intended and correct running, for which reason holders are arranged partly in front section 31 of the helmet, and partly in its rear section 32, back of the head section or neck section 36 according to one preferred design. Owing to this, a first, front part 6 of the support straps 6, 7, reaches a substantially vertically running and a second, rear part 7 of the support straps 6, 7, a substantially horizontal running or from the helmet 1 and to a position at a distance from and substantially below the ear of the wearer. Thus, the support straps 6, 7 will be able to run in a position along the cheek section of the wearer and in the direction of the jaw and below and at a distance from the ear and on to the back of the head of the wearer or neck. The support straps 6, 7 are, according to the embodiment, provided with an adjusting device 5 which is arranged to distribute a support strap 6, 7 in two parts 6 and 7 via a double folded section. To such a double folded section, a so-called chin strap 8 can be connected, or via a clincher 42. Moreover, to such a double folded section can a or a portion 16 in a locking device 16 be connected, whereby a second support strap 8 in the shape of a chin band can be locked round the chin of the wearer or the jaw. Other devices, which can be connected, are a chin strap 8 with a locking device 9 or a portion 16 of a locking device which are arranged to a support strap before that an adjusting device 5 or similar is arranged to the support strap 6, 7 which is subsequently arranged with each part 6 and 7 to protruding parts 4 of the holders 3 and attached or connected with the aid of a rivet 18 or similar attachment device. It may be seen to be advantageous if the support strap or straps 6, 7, or one or both parts 6 and 7, can turn in the holders 3 or theirs protruding part 4, which in turn will be arranged or shaped as rigid in form or stiff devices. As indicated for example in FIG. 1 a first part 6 of the support straps 6, 7 is arranged in the front section 31 of the helmet and in front of the ear of the wearer and a second part 7 of the support straps is arranged in the rear section 32 of the helmet, behind the ear of the wearer or arranged in one part 36 or parts which will cover the back of the head of the wearer and/or parts of the neck of the wearer. Reference designation 37 shows a shaping or recess for the ear of the wearer. The front section 31 of the helmet can be shaped as a visor 39 or the like.

Figure 2:
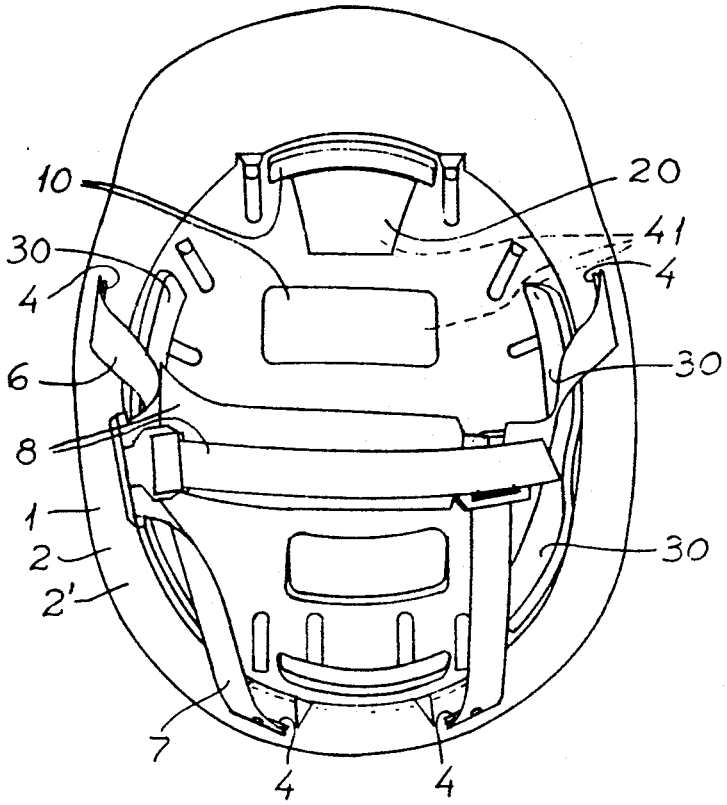
FIG. 2 shows from below a headgear according to the invention.
Figure 9:
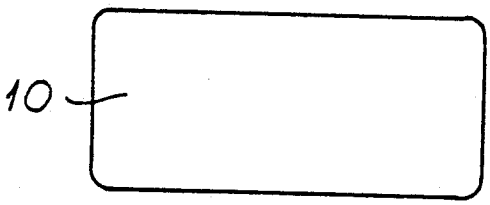
FIGS. 9–11 show from one side examples of different configurations of pads or similar, FIGS. 12*a–c* show from another side different thicknesses of the exemplified pads or similar in FIGS. 9–11.
Figure 10:
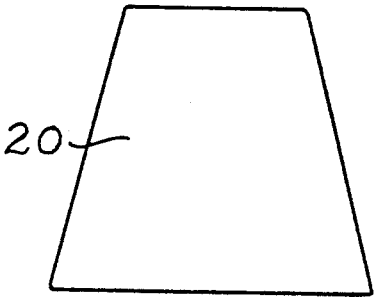
Figure 11:
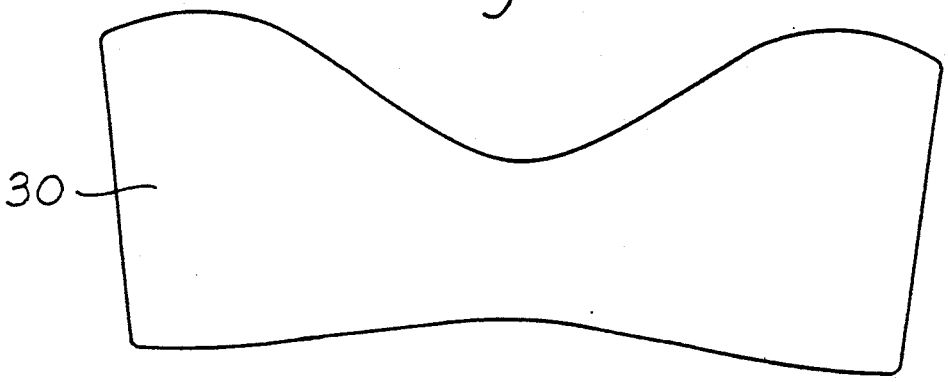
Figure 12A:
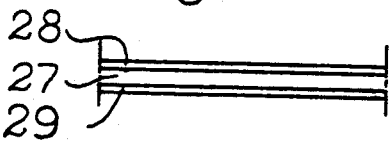
Figure 12B:
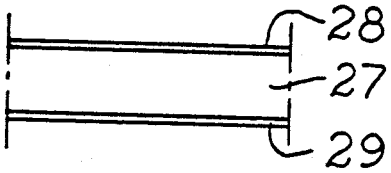
Figure 12C:
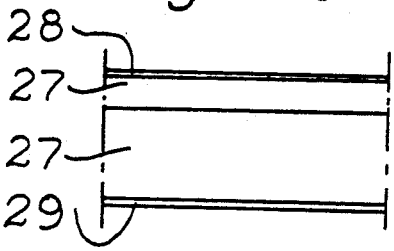
Figure 15:
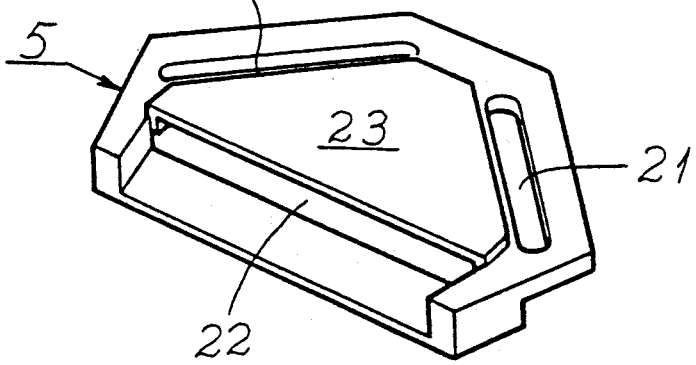
FIGS. 15–16 show in two perspective views an adjusting device.
Figure 16:
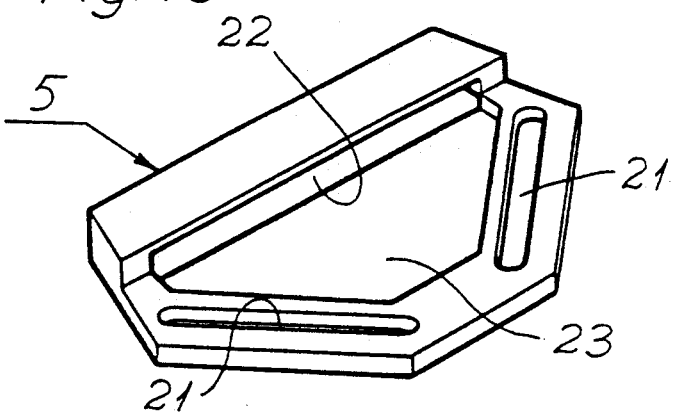
Figure 13:
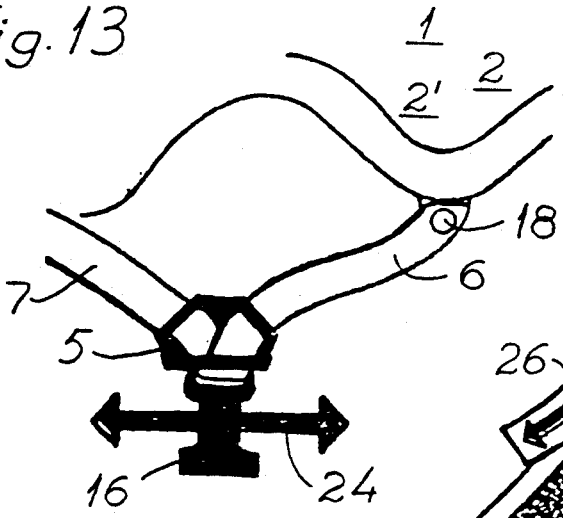
FIG. 13 shows from one side a part of a headgear, FIG. 14 show parts of support straps, chin bands and locking device.
Figure 14:
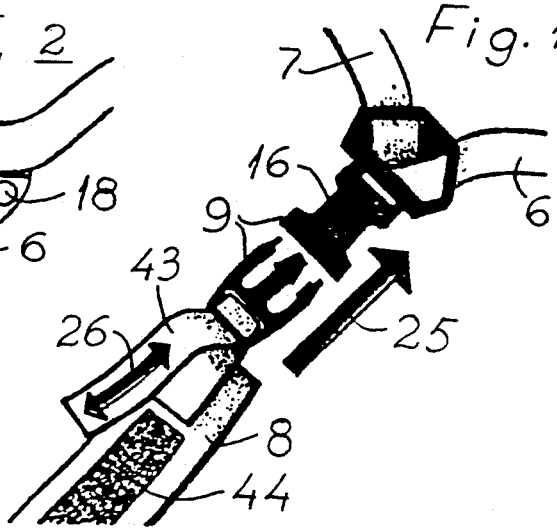

In order to ensure substantial protection the helmet must thus sit firmly secured on the head of the wearer and cover the forehead and back of the head. In this respect the helmet can easily be adjusted in size and according to different head shapes with the aid of contact devices 10, 20 and 30 in the shape of pads or the like which can be shaped such as comfort pads and improve the comfort of the helmet and a comfortable wearing of the helmet and permits the helmet to lie with an air column or an interval space to the head for good ventilation. Therefore, the helmet 1 comprises pads 10, 20 and 30, of which some pads show different configurations. Several such sets of pads can be included and which show different thicknesses and are arranged to be easily replaceable for adaptation and adjustment, whereby the crown, inner volume or similar of the helmet, hood or frame can be changed or adjusted. In FIG. 2 examples are shown of how different pads 10, 20 and 30 according to the FIGS. 9–11 have been arranged in the helmet. The pads can thus be shaped attachable in the helmet which can be provided with holding elements 41 for pads, such as bur fasteners or the like. The pads can or are in turn shaped from a yielding, flexible or other similar material or according to the embodiment from a layer of foam plastic material 27 provided with a fabric 28, 29, as a cotton terry, on both sides for the sake of comfort. The pads also provide a certain shock absorbing or energy absorbing effect, even if this is not the main purpose with the pads. Furthermore, the length of the support straps 6, 7 are adjusted with the aid of the adjusting device 5, see the arrow 24 in FIG. 13. On displacement of the adjusting device 5 the angles of both parts 6 and 7 of the support straps 6, 7 are changed. The length of a second support band 8 or a chin strap can be adjusted with the aid of an arranged adjusting element 43 in the shape of a band running through the locking device 9 or a portion of this. Adjustment can thus be made as shown with the arrow 26 and securing of the adjustment can be made with the aid of for example a locking element 44 in the shape of a clasp, bur fastener or the like. The arrow 25 will show how a portion of the locking device 9 is united with a second portion 16 for locking the helmet on the head by means of the locking device 9 and securing with the aid of the chin strap 8.

The adjusting device 5 or the like is formed as a band distributor which shows slots 21 to thread bands or straps 6, 7 or a part 6 and 7 in each opening 21 and a slot 22 to thread a double folded section or a portion of the strap 6, 7 through the slot, to which, as mentioned, different devices can be arranged which takes place before the strap 6, 7 is arranged to the adjusting device 5. The strap 6, 7 is subsequently arranged to the holders 3. In addition, the adjusting device 5 shows a contact portion 23 arranged as a contact surface or the like and which surface is smooth and mitigates the contact and pressure of the band distributor to the cheek or rather to the jaw or the neck.

Despite the relative thickness of the helmet, hood or frame, see reference designation 38, the helmet is light and comfortable to wear and ensures by virtue of the relatively thick wall a good energy absorbing and shock absorbing capacity which is the properties of expanded polystyrene.

Without exceeding the scope of the concept of the invention, modifications of the headgear, the hood or the frame, and the method of producing these, should be possible. Thus, the outer design or the form and dimension of the helmet are not necessarily decisive, since it is shaped in different sizes and for different purposes and for both children and adults. Additional attachment points and holders can, of course, be arranged or fewer holders if they are shaped together as an unit and molded into the frame as a reinforcement which improves the strength of the helmet with respect to breaking or cracking. It would therefore be possible within the scope of the invention to form and intermediate layer in the helmet of another material or another plastic material which is more rigid and tougher and above all more impenetrable or impenetrable for particularly shape or pointed objects, whereby a helmet according to the invention would find further areas of use than the areas primarily thought, such as a safety helmet for the children's play, travel in vehicles, the exercise of different sports, tobogganing, etc., and as a bicycle or recreation helmet or headgear, since it can be used even if one does not engage in activities where the risk of injury exists but use it as a headgear. In the case of an intermediate layer or a lamination then the said protruding parts are able to be shaped in the said intermediate layer and lamination. Furthermore, a holder in the form of a bow would not need to be shaped with a front and rear attachment device or part, but the bow would be able to be arranged for a running across the helmet and protrude on both sides for front attachment devices and with another bow for rear attachment devices or parts. If it is found appropriate it would be equally practical to shape, for example, a plate or the like as a rear attachment device which with parts protrudes from the frame and the helmet to form a rear attachment device. It is therefore not necessary that the attachment devices are shaped from a bow, but they can show whatever other appropriate design with respect to positioning and use, for example as a neck guard or back of the head reinforcing device.

The headgear, helmet, hood or frame according to the invention or the method to produce them are thus not restricted to what has been shown and described in connection with the embodiments but solely by the following claims.

I claim:

1. A helmet comprising:

a hood adapted to cover the head of a wearer, said hood comprising a porous, energy-absorbing molded plastics material having sufficient rigidity to sustain the shape of the hood, said hood having inner and outer surfaces both having borders and an edge extending between said surfaces at the borders thereof;

strap means for securing said hood to the head of a wearer; and means for securing said strap means to said hood;

wherein the securing means comprises a first portion located in part between said inner and outer surfaces and extending through said edge;

wherein said hood includes means, located between said inner and outer surfaces, for embedding at least a part of said first portion of the securing means located between said inner and outer surfaces, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means.

2. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

which said embedding means is the porous, energy-absorbing material of which the hood is formed.

3. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means in which said helmet has an edge extending between said inner and outer surfaces, and in which said securing means comprises an outer portion connected to said strap means and intermediate portion connecting said outer portion to said first portion, said intermediate proton extending through said edge of the helmet.

4. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

in which said first portion of the securing means is bow-shaped, and in which the securing means has two outer portions connected to said strap means, and two intermediate portions, each of said intermediate portions connecting one of said outer portions to said first portion.

5. A helmet according to claim 4 in which said helmet has an edge extending between said inner and outer surfaces, and said intermediate portions extend through said edge of the helmet.

6. A helmet according to claim 4 in which said bow-shaped first portion of the securing means has a compound curvature and extends from the side of the helmet to the rear of the helmet.

7. A helmet according to claim 4 in which said helmet has an edge extending between said inner and outer surfaces, and said intermediate portions extend through said edge of the helmet, and in which said bow-shaped first portion of the securing means has a compound curvature and extends from said edge at the side of the helmet to said edge at the rear of the helmet.

8. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

in which said first portion of the securing means has through holes, and in which portions of said embedding means extend through said holes.

9. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located in part between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

in which said first portion of the securing means has protrusions which extend into said embedding means.

10. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

in which said securing means comprises an outer portion connected to said strap means and an intermediate portion connecting said outer portion to said first portion, said intermediate portion extending through an exterior surface of the helmet from between the inner and outer surfaces of the helmet to the exterior of the helmet, said intermediate portion having flange means substantially flush with said exterior surface of the helmet.

11. A helmet comprising:

a hood adapted to cover the head of a wearer, said hood comprising a porous, energy-absorbing molded plastics material having sufficient rigidity to sustain the shape of the hood, and said hood having inner and outer surfaces;

strap means for securing said hood to the head of a wearer; and means for securing said strap means to said hood;

wherein the securing means comprises a first portion located between said inner and outer surfaces;

wherein said hood includes means, located between said inner and outer surfaces, for embedding said first portion of the securing means, said embedding means providing interior surface means engaging said first portion of the securing means; and wherein said first portion of the securing means is sustained substantially entirely by the engagement of said first portion and said interior surface means in fixed relationship to said hood against tension applied to said securing means by said strap means;

in which said helmet has an edge extending between said inner and outer surfaces, and in which said securing means comprises an outer portion connected to said strap means and an intermediate portion connecting said outer portion to said first portion, said intermediate portion extending through said edge of the helmet from between the inner and outer surfaces of the helmet to the exterior of the helmet, said intermediate portion having flange means substantially flush with said edge of the helmet.

* * * * *